US007186002B2

(12) United States Patent
Matthews et al.

(10) Patent No.: US 7,186,002 B2
(45) Date of Patent: Mar. 6, 2007

(54) FLASHLIGHT WITH SELECTABLE OUTPUT LEVEL SWITCHING

(75) Inventors: John W. Matthews, Newport Beach, CA (US); William A. Hunt, Foothill Ranch, CA (US)

(73) Assignee: Surefire LLC, Fountain Valley, CA (US)

( * ) Notice: Subject to any disclaimer, the term of this patent is extended or adjusted under 35 U.S.C. 154(b) by 36 days.

(21) Appl. No.: 10/732,873

(22) Filed: Dec. 9, 2003

(65) Prior Publication Data

US 2005/0128741 A1 Jun. 16, 2005

(51) Int. Cl.
*F21L 4/04* (2006.01)

(52) U.S. Cl. ..... 362/205; 362/204; 362/394

(58) Field of Classification Search ..... 362/196–208, 362/276, 802, 184, 394
See application file for complete search history.

(56) References Cited

U.S. PATENT DOCUMENTS

| | | | | |
|---|---|---|---|---|
| 1,214,583 | A | 2/1917 | Persons | |
| 4,388,673 | A | 6/1983 | Maglica | |
| 4,499,525 | A | 2/1985 | Mallory | |
| 4,527,223 | A | 7/1985 | Maglica | |
| 4,581,686 | A | 4/1986 | Nelson | |
| 4,677,533 | A | 6/1987 | McDermott et al. | |
| 4,760,504 | A | 7/1988 | Schaller et al. | |
| 4,876,416 | A | 10/1989 | Frantz et al. | |
| 4,947,291 | A | 8/1990 | McDermott | |
| 5,161,879 | A | 11/1992 | McDermott | |
| 5,418,433 | A * | 5/1995 | Nilssen | 315/175 |
| 5,498,934 | A * | 3/1996 | Nilssen | 315/224 |
| 5,629,105 | A | 5/1997 | Matthews | |
| 5,642,932 | A | 7/1997 | Matthews | |
| 5,685,637 | A | 11/1997 | Chapman et al. | |
| 5,722,755 | A | 3/1998 | Slape | |
| 5,790,013 | A * | 8/1998 | Hauck | 340/332 |
| 5,821,697 | A | 10/1998 | Weber | |
| 6,019,482 | A | 2/2000 | Everett | |
| 6,024,471 | A * | 2/2000 | McDermott | 362/394 |
| 6,046,572 | A * | 4/2000 | Matthews et al. | 320/116 |
| 6,095,661 | A | 8/2000 | Lebens et al. | |
| 6,183,105 | B1 | 2/2001 | Parker | |
| 6,249,089 | B1 * | 6/2001 | Bruwer | 315/200 A |
| 6,296,367 | B1 | 10/2001 | Parsons et al. | |
| 6,305,818 | B1 | 10/2001 | Lebens et al. | |
| 6,307,328 | B1 * | 10/2001 | Ko et al. | 315/200 R |
| 6,386,730 | B1 | 5/2002 | Matthews | |

(Continued)

*Primary Examiner*—Sandra O'Shea
*Assistant Examiner*—Jason Moon Han
(74) *Attorney, Agent, or Firm*—Langlotz Patent Works, Inc.; Bennet K. Langlotz

(57) ABSTRACT

A flashlight having a lamp, a power storage element, a switch, and an electronic controller. The controller has a switch input connected to the switch and operates in response to the input to deliver power from the power storage element to the lamp. The controller may be directly connected to each of the lamp, source, and switch. The switch may include several separate contact elements operating sequentially in response to movement of a switch actuator. The controller may provide different illumination levels and functions in response to different pressures and durations of actuation. The flashlight may include a dimmer level control to establish an intermediate "dimmed" output level, and operate to provide the selected dimmed output when the switch is depressed by an intermediate amount, and to provide a greater maximum output level in response to full actuation of the switch.

14 Claims, 3 Drawing Sheets

U.S. PATENT DOCUMENTS 6,474,833 B1 * 11/2002 Parsons et al. ..... 362/206
6,616,297 B1 * 9/2003 Chen ..... 362/206
6,709,129 B2 * 3/2004 Galli ..... 362/206
6,976,766 B2 * 12/2005 Galli ..... 362/206
2002/0067611 A1 * 6/2002 Yaeger ..... 362/184
2004/0008510 A1 * 1/2004 Mah ..... 362/192
2004/0190286 A1 * 9/2004 Chapman ..... 362/171

* cited by examiner

FIG. 1
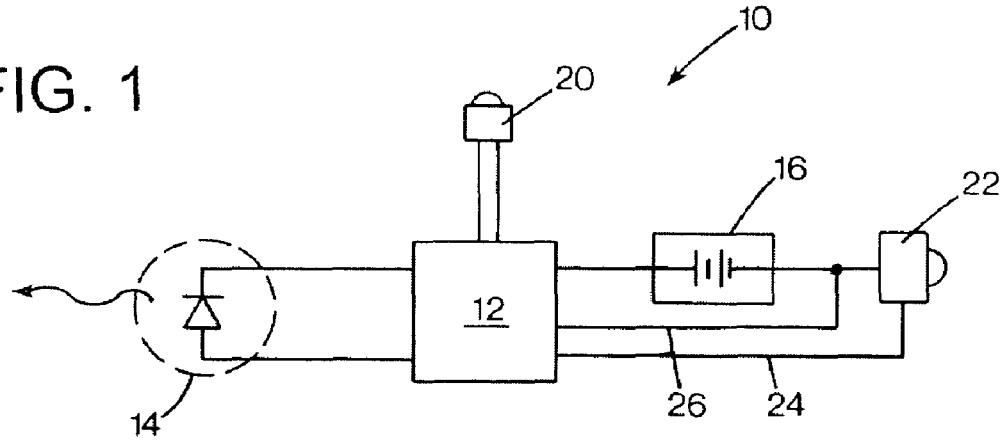
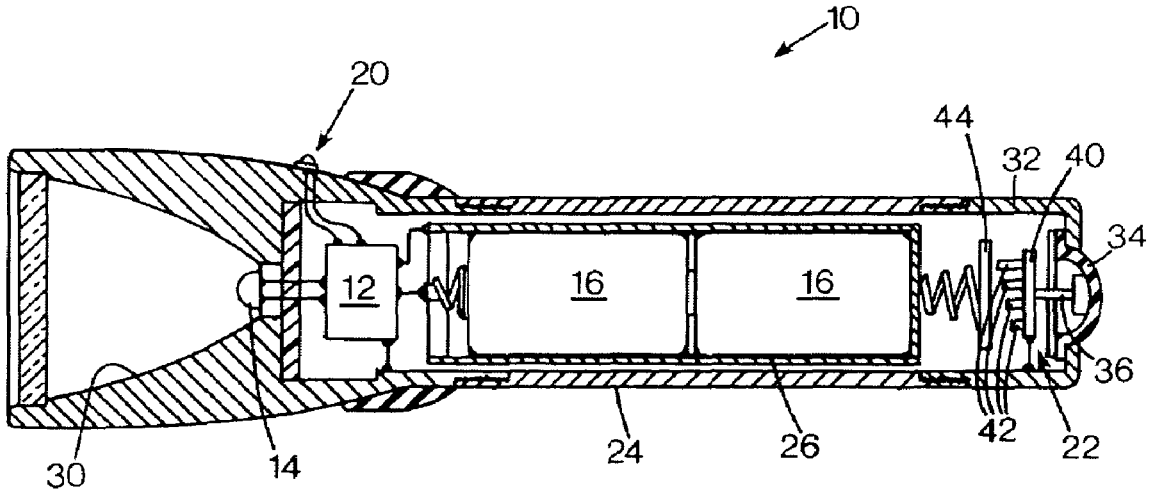
FIG. 2

FIG. 3
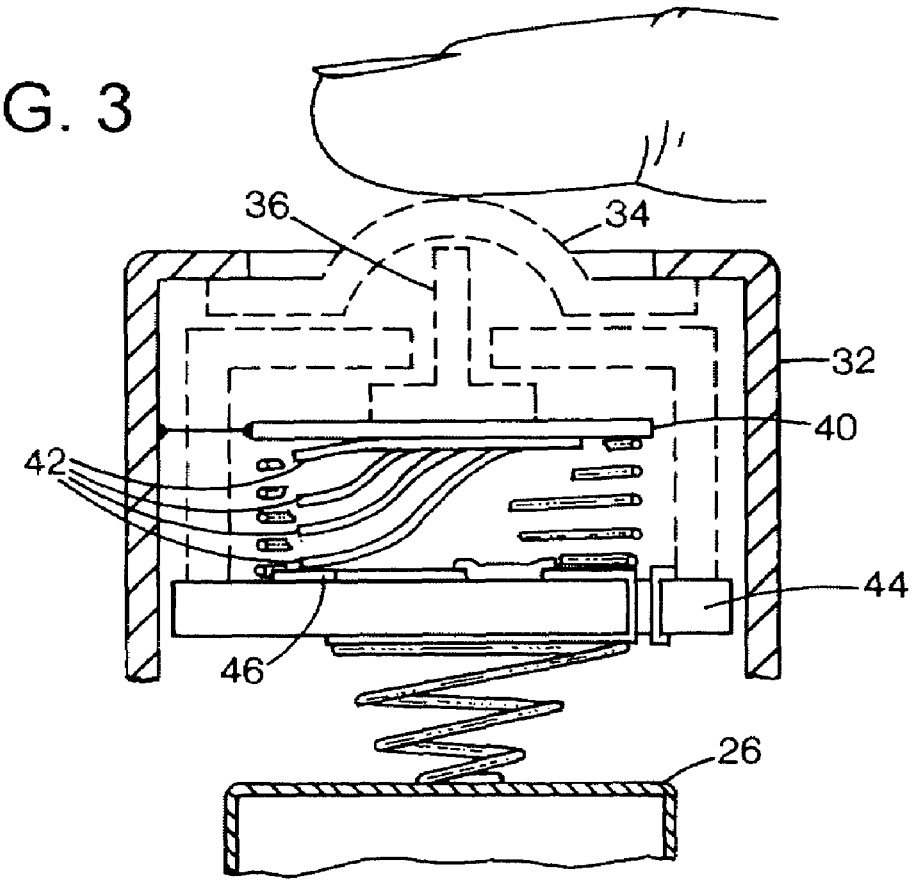
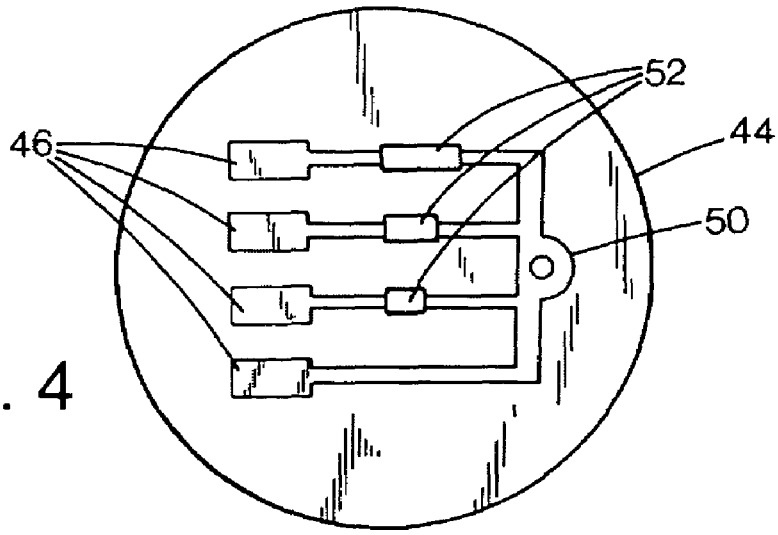
FIG. 4

FLASHLIGHT WITH SELECTABLE OUTPUT LEVEL SWITCHING

FIELD OF THE INVENTION

This invention relates to flashlights, and more particularly to switches for controlling flashlight output.

BACKGROUND OF THE INVENTION

Flashlights are conveniently sized battery powered portable light sources, which provide the user with a source of illumination. Said illumination could be white light or light of a specific color, or even light outside the visible range of wavelengths, such as ultraviolet or infrared radiation. The "color" or wavelength of the light will depend on the nature of the light source or light sources used in the flashlight. These would typically be either tungsten lamps, ARC lamps, light emitting diodes (LEDs), lasers, or any other emitter.

Because of the general nature of flashlights and their wide range of applications, it is very desirable for a flashlight to be able to emit, at the user's direction, different levels of light output, and/or different colors or wavelengths of light. This can be accomplished using multiple light sources or a single light source, which can be adjusted to provide different levels of light output.

The principal light source used in flashlights is the tungsten filament lamp, as alternatives suffered inadequate illumination, or excessive battery consumption. Tungsten filament lamps, however, cannot be effectively used as a variable output light source because they must be operated close to their design point (current & voltage) if they are to retain their efficiency in converting electrical energy to light. Generally speaking, the same thing can also be said about ARC lamps. Thus, if one wanted two significantly different light outputs from the same flashlight, this would require the use of two different lamps. Examples of such prior art systems are described in Matthews U.S. Pat. No. 5,629,105 and Matthews U.S. Pat. No. 6,386,730, the former teaching the use of a second lamp protruding through the reflector at a point offset to the side of the main lamp which is located at the focal point of the (parabolic) reflector, and the latter teaching the use of two lamps each with its own reflector, the reflectors merged together in a manner such that the light from each lamp interacts only with its own reflector.

In such existing systems, the switching system consists of mechanical contact arrangement where the physical axial displacement of a switch system element (either by direct finger or thumb pressure or by rotation of a tail cap or head of the flashlight) causes the first lamp to be connected to the battery, and additional applied pressure or flashlight element rotation causes the second lamp to be connected to the battery. In some cases the design is such that the first lamp is disconnected when the second lamp is connected to the battery. In other cases, the first lamp remains connected when the second lamp is connected.

In practice, such dual- or multi-source flashlights typically have a pressure switch located on the opposite end of the flashlight from the light source. This switch system, or tail cap, may be rotated through a range of angular positions, each providing a different response to application of a button on the pressure switch. Rotation of the switch on the helical threads connecting it to the flashlight body generates axial movement to move contacts toward or apart from each other. In a first position, the switch contacts are farthest apart, so that full pressure of the button has no effect. This is the "lockout" position. By rotating the switch to the second position, fully pressing the button connects the first lamp to the battery, but not the second (and usually brighter) lamp, which is controlled by more widely spaced contacts that remain locked out. In the third position, which is the position most normally used, moderate pressure on the button first connects the first lamp to the battery; greater pressure, including a "bottoming out" condition then connects the second lamp to the battery. In a fourth rotational position, the first lamp remains on when the button is not pressed and the second lamp is connected in response to additional pressure on the button or to additional rotation of the tail cap. In a fifth rotational position both lamps are connected without the application of any pressure on the button.

While effective, such dual-source lights have several limitations. First, they require the user either to maintain button pressure throughout illumination, or to rotate a switch between operating modes. This requires either continuous use of one hand, or the occasional use of both hands (to rotate the switch), either of which may be disadvantageous for critical military and law enforcement applications.

When set to certain switch modes existing lights do not enable rapid illumination for emergencies. When in the lockout mode or the second mode noted above, maximum pressure will not illuminate the brighter lamp. Changing modes takes time, and requires two hands, which may be disadvantageous in an emergency.

Existing lights have limited choice of light levels. Many tasks require different illumination levels. The moderate level of illumination provided by the first lamp (LED) for many tasks such as camping and ordinary trail navigation may be much brighter than would be desired for map reading in critical military situations. Other applications may require still different moderate lights levels when the full brightness (and shorter run time) of an incandescent lamp is not suitable. Moreover, there is a substantial range of possibly desired brightness levels between the maximum of the first lamp and the full brightness of the second lamp that are not obtainable.

It should be noted that the term "lamp" is used in its most general meaning, namely that of any light source (which could be a tungsten filament lamp, an LED, or an ARC Lamp) of any wavelength.

SUMMARY OF THE INVENTION

The present invention overcomes the limitations of the prior art by providing a flashlight having one or more lamps, a power storage element, a switch, and an electronic controller. The controller has switch input connected to the switch and operates in response to this input to deliver power from the power storage element to the lamp or lamps used in the flashlight. The controller may be directly connected to each of the lamps, the power source, and the switch system. The switch may include several separate contact elements each connected to a respective electrical component such as a resistor, and all operable to contact a common contact sequentially in response to movement of a switch actuator. The controller may provide momentary illumination of the lamp during an application of a first degree of force, cease illumination of the lamp in response to cessation of the force. The controller may provide sustained illumination of the lamp in response to application of a greater second degree of force, even after cessation of the force. The controller may further cease illumination in response to a second application of force. The flashlight may include a dimmer level control to establish an intermediate "dimmed" output level, and operate to provide the selected dimmed output when the switch is depressed by an intermediate amount, and to provide a greater maximum output level in response to full actuation of the switch.

BRIEF DESCRIPTION OF THE DRAWINGS

FIG. 1 is a simplified block diagram of a flashlight according to a preferred embodiment of the invention.

FIG. 2 is a sectional view of the flashlight of FIG. 1.

FIG. 3 is an enlarged sectional side view of the switch assembly of the flashlight of FIG. 1.

FIG. 4 is an enlarged plan view of a switch assembly component of the flashlight of FIG. 1.

DETAILED DESCRIPTION OF A PREFERRED EMBODIMENT

Figure 5:
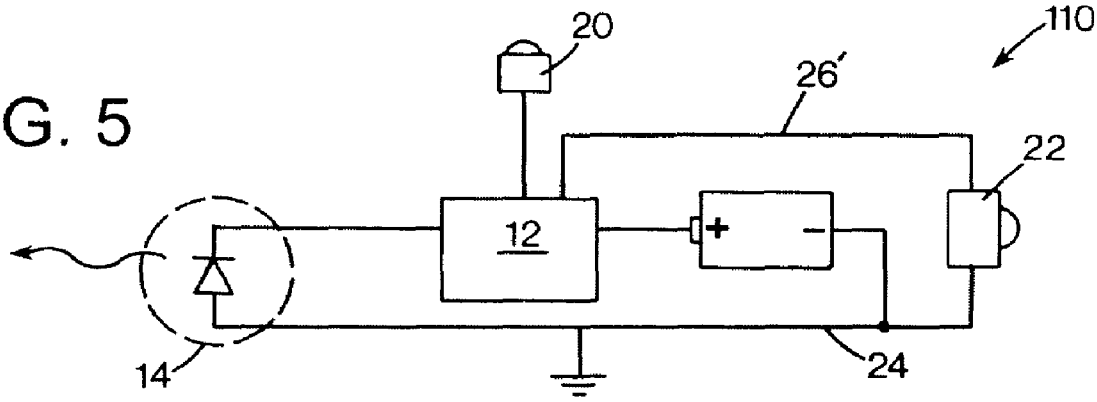
FIG. 5 is a simplified block diagram of a flashlight according to an alternative embodiment of the invention.

FIG. 1 shows a schematic drawing of a flashlight 10 according to a preferred embodiment of the invention. The flashlight includes a micro-processor control circuit 12 that is directly connected to a lamp 14, battery 16, dim level control selector 20, and operation switch 22.

In the circuit diagram shown in FIG. 1, all leads from all components are connected directly to the control circuit 12. The lamp has both leads connected to the controller, as are both ends of the battery, with current flowing primarily through a high conductivity path 26. Both leads of the dim selector 20 are also connected to the control circuitry. The electrical path is provided over the length of the flashlight either by the (metal) body, or by an electrically isolated metallic sleeve that connects at its closed rear end to the rear of the battery 16, and at its front end to controller 12. The sleeve may be replaced in alternative embodiments by a single conductor wire or circuit element such as a flex circuit to provide the same function.

The switch element also has both leads connected to the controller, although it will utilize the high conductivity path 26 as one of its leads, making the connection at its closed rear end, of the sleeve. The other path 24, which is typically a low current path, can be a single wire, a flex circuit, a conductive trace applied to the interior of the housing or to the metallic sleeve (if used) and isolated therefrom by an insulating film layer, or the (metallic body itself).

This arrangement allows the controller to detect the resistance presented by the switch to determine its state, as will be discussed below. It also insures that the switch is not serially connected in the loop with the primary current flow from the battery to the lamp, avoiding parasitic losses due to switch resistance.

The lamp 14 is preferably a light-emitting diode (LED), and may be a single lamp that operates efficiently over a wide range of input power to produce a wide range of possible light outputs. In alternative embodiments, there may be multiple light sources, either interconnected to provide a single, switchable (and dimmable) array, with all sources operating in the same manner. In other alternatives, there may be separate lamps or independently controllable lamp elements, so that color hue changes may be obtained by operating different color components in different combinations, or so that dimming control may be obtained by illuminating a different number of the components. The lamp may be an alternative light source, such as a tungsten halogen lamp or any other light source, although LED lamps are believed best suited to presently provide efficiency over a wide range of powers and brightness.

The dim level selector 20 may be of any type to provide the operator with the means to select a "dim" brightness level at any intermediate level within the range of the lamp's capability. The dim level selector is shown as connected directly to the controller 12, although in alternative embodiments the dim level selector may communicate with the controller by other means, including magnetic or radio frequency means. For instance, a rotatable ring may have one or more magnets, and the interior of the flashlight may contain a hall effect sensor connected to the controller to sense position or movement of the ring.

The dim level selector may have a selector element such as a dial or slider that establishes a dim level based on its position. Alternatively, the selector may establish a dim level by responding to the operator's duration (or magnitude) of pressure on a switch, such as by gradually rising in brightness in response to actuation until the selector is released. A dim level may be set by numerous alternative means, including by operation of the primary control switch 22, such as by its rotational position, by a series or sequence of impulses, or by any other means.

The flashlight 10 includes a conductive housing that is illustrated schematically in FIG. 1 by a ground bus line 24 extending between a battery electrode and switch lead, and the controller 12. As will be discussed below, the housing is a cylindrical tube defining a bore closely receiving one or more cylindrical batteries 16. Thus, it provides a single electrical path from the switch 22 at the rear end of the flashlight, and the controller 12 at the front end.

A second electrical path is provided over the length of the flashlight by the conductive sleeve element 26 shown schematically here, and detailed below. The sleeve is electrically isolated from the housing, and connects at its closed rear end to the rear of the battery 16 and to a contact from the switch 22, and at its open front edge to the lamp 14 and to the controller 12. The sleeve may be replaced in alternative embodiments by a single conductor wire or circuit element such as a flex circuit to provide the same function. Other alternatives include a conductive trace applied to the interior of the housing (isolated therefrom by an insulating film layer) and connected at each end to the appropriate components. The batteries themselves provide a third electrical path.

The second path provided by the sleeve allows the switch to connect directly with the controller over two paths, so that the controller may detect a resistance presented by the switch to determine its state, as will be discussed below. The second path further ensures that the switch is not serially connected in the loop with the primary current flow from the battery to the lamp, avoiding parasitic losses due to switch resistance.

FIG. 2 shows the physical structure of the preferred embodiment, with a lens 30 forward of the lamp 14. The housing is has several essentially cylindrical portions defining a chamber for containing the lens, lamp, controller 12, batteries, and switch 22. The dimmer level control 20 is shown in simplified form, and may take any form including a ring rotatable about the housing. The switch (shown in simplified form) is contained within a tail cap 32 having an elastomeric flexible dome 34 covering a switch actuator 36. The switch has a movable portion 40 having several contacts 42 each connected to the housing ground. The movable portion reciprocates axially with respect to a fixed switch portion 44 connected to the conductive sleeve 26.

As shown in FIG. 3, the contacts 42 of the movable portion 40 are leaf springs, each extending a different distance from a base panel that is connected to the housing ground. The switch show in FIGS. 2 and 3 is simplified for clarity of the principles of its operation. The actual switch of the preferred embodiment is configured like existing such switches that allow a bi-level operation. Such switches have the contacts arranged in arcs or annuluses to allow the switch to function when the tail cap is rotated through a range of positions. The preferred embodiment would have its contacts configured as such, although this would unduly complicate the illustrations, which are shown in schematic form.

All the leaf spring contacts are connected to each other. As the switch is depressed over its range of axial travel, the contacts contact the fixed element 44 in sequence. As shown in FIG. 4, the fixed element includes an array of pads 46, each positioned to be contacted by a respective end of a leaf spring contact 42. The pads are all connected to a node 50 that connects via a plated through-hole or other means to the opposite side of the element, which thereby connects to the sleeve 26. Each pad 46 connects to the node 50 with a different intervening resistance. Several resistors 52 are provided to intervene between the various pads and the node.

Before the switch button is depressed, the resistance between the fixed portion (and thereby the controller's connection to the sleeve) and the movable portion (and thereby the controller's connection to the housing ground) is infinite. When the button is slightly depressed, a first leaf spring contact makes contact with a pad associated with a resistor. The controller may thus determine by this resistance across these lines that the button has been pressed to an intermediate position. In the preferred embodiment, the controller then operates the lamp at the pre-selected dimmed illumination level.

When the button is further depressed, another leaf spring contacts a pad. In the simplest case, the switch has only two contacts (not the four illustrated), and the second contact would contact a pad having no resistor. This reflects a condition when the switch is fully depressed, and would cause the controller to provide full brightness illumination. In the more complex embodiment illustrated, there are five button states (including the released condition) determinable by the controller, so that various brightness levels or preselected dimmed or hue outputs might be provided based on the switch condition. The preferred embodiment requires at least two different contacts that make contact at different depression amounts of the button, and are connected to at least one resistor to provide a different output resistance depending on whether one, both, or neither are making contact. In the simple case, one extending spring contact may protrude, with the moving element panel 44 making direct contact in the fully actuated position.

By having an electronic controller connected to the switch, additional switching and control capabilities may be provided that are not provided by a conventional switch in line with the power loop. The illumination of the lamp need not correspond to the position of the switch. This enables a "click-on, click-off" switch mode in which a momentary actuation of the switch causes sustained illumination, and a second momentary actuation ceases illumination. This function is provided in the absence of a conventional mechanical switch that switches between open and closed contact positions using springs and ratcheting mechanisms, in the manner of a ballpoint pen or other conventional on-off flashlight switches.

By electronic control of switching operations, significant additional capabilities are made available. The controller may detect the duration of pressure on the button, the magnitude of pressure (for embodiments with multiple leaf springs for at least one intermediate actuated position), and the number and pattern of actuations (enabling distinguishing of commands in the manner of a single or multiple click computer mouse.)

In the preferred embodiment, the tail cap 32 may be unscrewed from the housing a sufficient amount to prevent any switch contacts from making contact even when the button is fully pressed, providing a lockout position for storage to prevent inadvertent discharge of batteries or unwanted illumination during critical operations.

For normal operation, the tail cap is screwed tightly to the flashlight body to an "operational condition". This differs from conventional flashlights that require the tail cap to be in an intermediate rotational position for selective operation (full screw-down providing constant-on operation in such lights.) This reduces potential operator error, and avoids the need for testing operational condition to ensure proper rotational position in advance of a critical operation, or after replacement of batteries.

When in the operational condition, displacement of the button to a first intermediate position (or intermediate pressure, for strain gauge buttons) causes the controller to provide power to the lamp for illumination at a pre-selected dimmed level, but only while the button is displaced. This provides momentary illumination, or a "dead man's" capability, so that the light turns off when pressure is ceased.

Displacement to a second intermediate position (such as when a second leaf spring makes contact in the switch, so that the controller detects a different resistance level) causes the controller to operate the lamp at the same pre-selected dimmed level, but with sustained operation upon release of the button. The switch may include a mechanical detent mechanism to provide tactile feedback to the operator to indicate that sustained illumination will be provided, or the rubber boot on the tail cap button may be designed with an over-center operation characteristic that provides a distinctive tactile feel when pressure beyond the required level to reach the second intermediate position is provided. In alternative embodiments, feedback devices may include electronic transducers in the flashlight connected to the controller, such as an audio annunciator that provides a "click" sound, or tactile transducers such as piezoelectric devices that provide a tactile response.

When illuminated at the preselected dimmed level, any pressure of the button less than the second intermediate position has no effect, while pressure beyond the threshold that led to sustained illumination and release beyond the first intermediate level will cease illumination.

When in the off condition, or when illuminated at the preselected dimmed level, displacement of the switch beyond the second intermediate level to a third or maximum level causes the controller to provide maximum illumination in a "panic" mode. In the preferred embodiment, full pressure on the switch generally causes sustained illumination at the maximum illumination level. To avoid unintended max illumination when a user intending to "click on" at the preselected dimmed level inadvertently presses momentarily with excessive force to the third level, the controller is programmed to provide sustained max illumination only when the contact at the third level is made for more than a brief pre-selected duration. In such an embodiment, the momentary click by a user to invoke the pre-set dimmed level may result in a momentary flash at the max brightness level, but this ensures that users requiring max brightness receive immediate illumination. In an alternative embodiment where immediate max illumination is not critical, the controller may be programmed to delay max illumination until after the button has been depressed more than the momentary threshold, avoiding the max flask when intermediate lighting is desired. In such an embodiment, maximum output is slightly delayed to ensure at least slightly sustained duration of pressure more than the fraction of a second that would correspond to accidental excess pressure.

From the maximum illumination condition, pressure on the switch beyond the third displacement amount and release of pressure will cease illumination. The controller may be programmed to return from the max illumination to the preselected dimmed level based on whether the light was operating in the preselected level when the max illumination was initiated. The controller may alternatively be programmed to select an illumination condition upon cessation of max illumination based on the degree of switch actuation, such as by turning off after pressure to (and release from) the third level, and by switching to the preselected level after pressure to (and release from) the second level.

In alternative embodiments, the capability to detect switch application duration enables significant flexibility of function. For instance, the max brightness operation may be established as either sustained or momentary based on duration of application beyond the first brief time threshold set to avoid intended max illumination as discussed above. For switch pressure sustained longer than a second threshold greater than the first, the controller provides momentary max illumination only during such pressure. For pressure more than the first duration but less than the second (such as a deliberate but brief application) the action is read by the controller as a "click on" command.

The programmability and flexibility of the switch control provides further advantages in alternative embodiments. Programming may be fixed, or customized based on institutional purchaser requirements, or programmed on an individual basis by each operator. Some applications will prefer programming that avoids accidental max illumination (such as for infantry troops operating at night), while other applications will prefer ready access to max illumination without delay or difficulty (such as for police work.)

The programmable capability of the controller with the electronic switch will provide the user (or a service agency) the capability to re-program the operating characteristics of the device. For instance, where a second dim-level control switch is not desired, the user may invoke a programming mode by a selected sequence of switch actuations. This may be a sequence of pressures to different degrees, a sequence of a number of clicks, or a sequence of clicks of different durations, such as Morse code. Once in a selected programming mode, pressure on the switch may cause the light level to ramp up gradually, so that the user sets the preselected dimmed level by releasing the switch when the dim level is desired. Such a mode might be invoked by a simple double click of the switch.

For a flashlight having more than one different light source, such as having multiple colors, the user may program the color (or invisible wavelength) to be output at different modes. This may include selecting hue based on which of several different color lamps (such as RGB LEDs) are illuminated, and in what relative brightnesses. The ability to record and store sequences of different durations also permits the storage of messages (such as entered by Morse code) and subsequent transmission in a regulated format that is readily receivable by other electronic devices. With the fast response time of LED lamps relative to incandescent, such messages may be "hidden" during flashlight operation (in visible or infrared wavelengths) as brief, possibly imperceptible variations of the output level.

The controller may be of any conventional type, programmed and programmable for the various functions above, the circuitry includes a power switching device such as a FET that operates to provide a selected power level to the lamp(s) based on the controller input.

FIG. 5 shows an alternative circuit block diagram of a flashlight 110 having the same capabilities at that illustrated in FIG. 1, but with the sleeve (or alternate second conductive path) 26' being connected only between the switch and the controller, so that the battery power loop passes through the housing ground 24. This may be suitable for applications in which the second conductive path 26' has a high resistance, or low current carrying capability.

While the above is discussed in terms of preferred and alternative embodiments, the invention is not intended to be so limited. For instance, many of the above functions and features of a programmable controller may be provided my other means, and the interface between the switch (which may be located at any position) and the controller need not be hard-wired, but may include data transmitted by radio frequencies emitted by the switch and received by the controller. Alternatively, communication may be provided by optical means, such as by an infrared emitter on the switch and a corresponding detector associated with the controller. Such optical communication may be made by line of sight in a passage adjacent to the batteries within the tube, through an optical conduit such as a fiber, or through a housing member having optically transmissive qualities.

The invention claimed is:

1. A flashlight comprising:

a lamp;

a power storage element;

a switch;

an electronic controller;

the controller having a switch input connected to the switch;

the controller being operable in response to the input to deliver power from the power storage element to the lamp;

the flashlight having an elongated housing having the lamp at a first end and the switch at an opposed second end, and including at least two independent electrical paths, each electrical path extending from the first end to the second end;

each electrical path extending between the controller and the switch; and wherein the switch has a plurality of different electrical states in addition to an off state, and wherein the electrical state is based on a degree of externally applied force.

2. The flashlight of claim 1 wherein the switch is operably connected directly to the switch input.

3. The flashlight of claim 1 wherein the controller, lamp, and power storage element are connected to each other via a power circuit bypassing the switch, such that current for illuminating the lamp does not pass through the switch.

4. The flashlight of claim 1 wherein the switch is operable within a range of conditions and is operable to transmit an electrical state corresponding to a condition to the controller.

5. The flashlight of claim 1 wherein the switch includes a plurality of separate contact elements each connected to a respective electrical component, and all operable to contact a common contact sequentially in response to movement of a switch actuator, such that the number of separate contacts contacting the common contact is based on the degree of applied external force.

6. The flashlight of claim 5 wherein the switch includes at least a resistor, and the electrical states include a plurality of different resistance values.

7. A flashlight comprising:

an electronic controller;

a lamp connected to the controller;

a power storage element connected to the controller;

a switch electrically connected to the controller;

the switch being operable within a range of conditions and is operable to transmit an electrical state corresponding to a condition to the controller;

the switch having a plurality of different electrical states in addition to an off state, and wherein the electrical state is based on a degree of externally applied force; and wherein the switch is biased to the off state.

8. The flashlight of claim 7 wherein the switch includes a plurality of separate contact elements each connected to a respective electrical component, and all operable to contact a common contact sequentially in response to movement of a switch actuator, such that the number of separate contacts contacting the common contact is based on the degree of applied external force.

9. The flashlight of claim 8 wherein the switch includes a resistor network, and the electrical states include a plurality of different resistance values.

10. The flashlight of claim 7 wherein the switch is located at an end of the flashlight opposite the lamp.

11. A flashlight comprising:

a lamp with a variable light output level up to a maximum output level;

a switch operable through a range of conditions ranging between a released position and a fully actuated condition;

a power storage element;

a dimmer facility operable to select a dimmed output level below the maximum output level;

an electronic controller operably connected to each of the lamp, the switch, the power storage element, and the dimmer facility;

the controller operable to provide illumination of the lamp at the dimmed output level in response to an application of a first degree of force on the switch, only during the duration of application of such force;

the controller operable to provide illumination of the lamp at the maximum output level in response to application of a greater second degree of force on the switch, only during the duration of application of such force.

12. The flashlight of claim 11 including in response to application of the first degree of force for less than a selected duration, sustaining illumination of the lamp at the dimmed output level after cessation of the force.

13. The flashlight of claim 11 wherein the controller is operable to maintain the lamp in an off state in the absence of an application of force.

14. A method of operating a flashlight having a light source with variable light output up to a maximum output level, a first control operable to establish an intermediate dimmed level, and a separate switch operable through a range of conditions ranging between a released position and a fully actuated condition, the method comprising:

operating the first control to establish a dimmed level at an output less than the maximum level;

in response to actuating the switch to an intermediate condition between the released position and the fully actuated position by maintaining a first degree of force, illuminating light source at the dimmed level;

in response to actuating the switch to the fully actuated condition by maintaining a second degree of force greater than the first degree of force, illuminating the light source at the maximum level; and in response to cessation of force ceasing illumination of the light source.

* * * * *